US009345944B2

(12) United States Patent
Fox

(10) Patent No.: US 9,345,944 B2
(45) Date of Patent: May 24, 2016

(54) GOLF AID FOR ALIGNING STANCE

(71) Applicant: Amy Fox, Mansfield, TX (US)

(72) Inventor: Amy Fox, Mansfield, TX (US)

( * ) Notice: Subject to any disclaimer, the term of this patent is extended or adjusted under 35 U.S.C. 154(b) by 0 days.

(21) Appl. No.: 14/569,234

(22) Filed: Dec. 12, 2014

(65) Prior Publication Data

US 2015/0099593 A1 Apr. 9, 2015

Related U.S. Application Data

(63) Continuation-in-part of application No. 13/915,349, filed on Jun. 11, 2013, now abandoned.

(51) Int. Cl.
*A63B 69/36* (2006.01)
*A63B 71/06* (2006.01)

(52) U.S. Cl.
CPC ..... *A63B 69/3667* (2013.01); *A63B 69/3608* (2013.01); *A63B 71/0622* (2013.01); *A63B 2071/0625* (2013.01); *A63B 2071/0655* (2013.01); *A63B 2207/02* (2013.01); *A63B 2220/16* (2013.01); *A63B 2225/50* (2013.01)

(58) Field of Classification Search
CPC ..... A63B 69/3667; A63B 225/502
USPC ..... 473/131, 218–223, 266, 269, 409
See application file for complete search history.

(56) References Cited

U.S. PATENT DOCUMENTS

| | | | | |
|---|---|---|---|---|
| 5,658,203 | A | 8/1997 | Shub | |
| 5,704,846 | A | 1/1998 | Johnson | |
| 6,148,280 | A * | 11/2000 | Kramer | A63B 69/3608 340/524 |
| 7,821,407 | B2 * | 10/2010 | Shears | A61B 5/1127 340/573.1 |
| 7,896,756 | B2 | 3/2011 | Choi | |
| 2006/0166737 | A1 | 7/2006 | Bentley | |
| 2009/0258719 | A1 | 10/2009 | Wortman | |

FOREIGN PATENT DOCUMENTS

| | | | |
|---|---|---|---|
| GB | 2424840 | A | 10/2006 |
| JP | 0321274 | A | 1/1991 |
| JP | 2010240433 | A | 10/2010 |
| KR | 1020070095407 | A | 9/2007 |

* cited by examiner

*Primary Examiner* — Nini Legesse
(74) *Attorney, Agent, or Firm* — James E. Walton

(57) ABSTRACT

A training device has a base unit configured to provide sensory feedback to a user and a belt unit configured to be worn by the user and emit signals toward the base unit. An electronic system housed in the base unit detects the signals emitted by the belt unit and provides sensory feedback indicating the angular alignment of the belt unit with respect to the base unit.

20 Claims, 19 Drawing Sheets

GOLF AID FOR ALIGNING STANCE

This application is a continuation-in-part of U.S. application Ser. No. 13/915,349, filed 11 Jun. 2013, titled "Golf Aid for Aligning Stance," which is incorporated herein by reference for all purposes.

BACKGROUND

1. Field of the Invention

The present application relates in general to golf training devices, and in particular, to devices for determining the proper alignment and angle of a user in relation to a reference location.

2. Description of Related Art

A plurality of devices abounds for teaching correct golf techniques. A skill to develop in golf is the ability to consistently strike a ball and be able to control accuracy and distance. Typically, devices focus on the swing of a player. For example, some devices attach restrictive apparatuses for locating the arms of a golfer during the swing motion. Additionally, others correct the posture of the golfer by teaching proper rotation and movement. In fact, the swinging motion of a golfer can be recorded using selectively located sensors across the body. Each of these types of devices generally works to address the quality of swing or range of motion of a golfer but fail to address the stance of the golfer in relation to the ball and the hole. Golfer's need to practice and master proper alignment with the hole to ensure the consistent stroke will be accurate.

Although great strides have been made in golf training devices, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
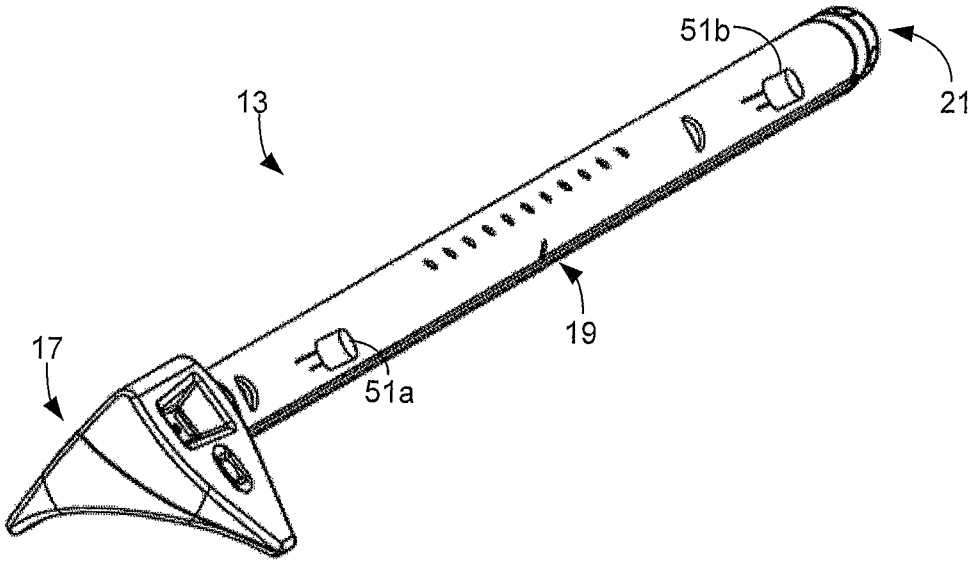
FIG. 1 is a perspective view of a base unit in a training device according to the preferred embodiment of the present application.

While the system and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 2:
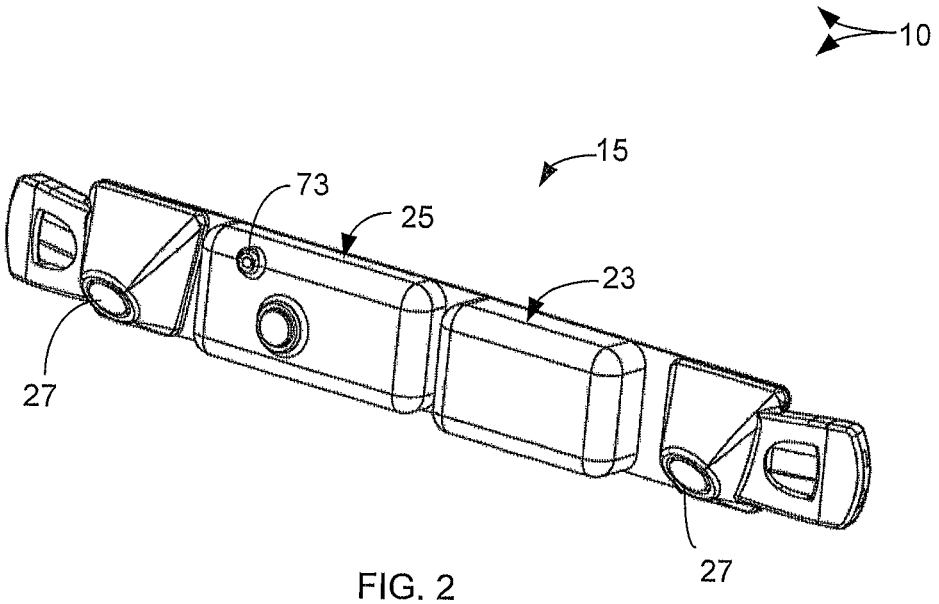
FIG. 2 is a perspective view of a sensory unit according to the preferred embodiment of the present application.

Referring to FIGS. 1 and 2 in the drawings, a training device 10 is illustrated. Training device 10 includes a base unit 13 (FIG. 1) configured to communicate with a sensory unit 15 (FIG. 2) to properly align the stance of a golfer with a reference location, such as a hole in a golf course for example. Base unit 13 houses hardware and software used to calculate the user's alignment with respect to base unit 13 as well as hardware and software used to display such alignment to the user. Both base unit 13 and sensory unit 15 emit wireless signals between each other for the purpose of calculating the alignment of the user with that of the reference location.

Base unit 13 includes a display assembly 17, an indicator assembly 19, and a battery unit 21. Base unit 13 is configured to provide sensory feedback to the user regarding user alignment and, in some embodiments, the translation of the user with respect to base unit 13. The sensory feedback may be performed through use of a display, visual indicators, audible indicators, and/or through physical indicators. Physical indicators may refer to notifications that are communicated to the user through the sensory function of touch. A user is able to correct such alignment and receive relatively instantaneous feedback of the adjusted alignment. Both display assembly 17 and indicator assembly 19 are configured to provide sensory feedback to the user.

Base unit 13 is configured to be transportable by the user form location to location. In the preferred embodiment, unit 13 is used to assist a user in properly aligning themselves with a hole on a golf course when approaching the ball. Therefore, unit 13 is sized to be accessible and carried within a conventional golf bag. Unit 13 has an elongated shape with a singular bulbous end (display assembly 17). For example, the overall length of unit 13 can be 34-36 inches, similar to that of a typical golf club. Additionally, the diameter of a central portion (indicator assembly 19) of unit 13 may be anywhere from 0.75 inches to 1.25 inches. Unit 13 is configured to maintain a center of gravity approximate to its dimensional center. This is to ease handling of unit 13 into and out of a golf bag or other transportation carrying case.

While not in a transportation carrying case, unit 13 is configured to rest in contact with the ground and aligned to a reference location. Display assembly 17 and/or external protrusions act to stabilize unit 13 on the ground. Such external protrusions may be integral to the housing 29 of unit 13. Other embodiments may use interchangeable or deployable protrusions, such as legs for example. Unit 13 may also rest on an exterior surface being elevated to some degree from the surface of the ground in alternative embodiments.

Sensory unit 15 includes a battery unit 23, electronics 25 (hardware and software), and one or more sensors/emitters 27. Electronics 25 regulate the operations of sensory unit 15. Sensory unit 15 is configured to transmit position data of the user in relation to base unit 13. Unit 15 selectively emits/transmits signals from sensors 27 to base unit 13. Sensors 27 are ultrasonic transducers in the preferred embodiment, however, it is understood that sensors 27 may be other wireless types of emitters suitable for wireless communication. Sensors 27 are coupled to portions of the body of the user in the preferred embodiment. For example, sensory unit 15 may be configured as a belt as seen in FIG. 1, wherein sensors 27 are approximate opposing ends of the hips of the user. Sensory unit 15 is adjustable to suit the size of the user. For example, where unit 15 is a belt, the belt size may be adjustable (i.e. 24-28 inches).

Although wireless communication has been described as the preferred use between base unit 13 and sensory unit 15, it is understood that other embodiments may use a direct wired communication. Additionally, although specific dimensions have been disclosed, it is understood that unit 13 is not limited to those specific dimensions. It is understood that unit 13 may be used in other applications outside of golf, and as such, dimensioning of unit 13 may vary in accordance with each application.

Figure 3:
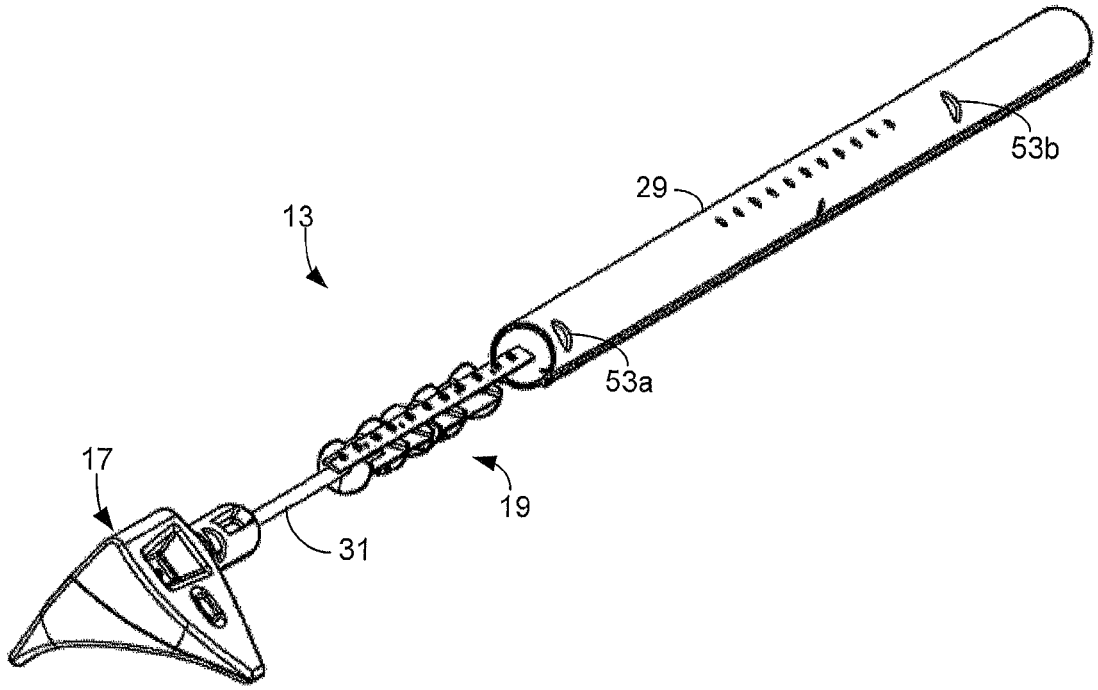
FIG. 3 is an exploded view of the base unit of FIG. 1.

Referring now also to FIG. 3 in the drawings, an exploded view of base unit 13 is illustrated. As seen in FIG. 3, unit 13 also includes a housing 29 configured to surround portions of battery unit 21 and indicator assembly 19. Housing 29 is tubular in nature. Battery unit 21 is coupled to housing 29 on an end opposite display assembly 17. Within housing 29 is a locating bar 31. Bar 31 provides internal support and areas of attachment for various assemblies of unit 13. Additionally, bar 31 provides rigidity and weight. Bar 31 can be used to adjust the center of gravity of unit 13 in light of the assemblies coupled to housing 29.

Referring now also to FIGS. 4-7 of the drawings, display assembly 17 is illustrated. Display assembly 17 includes a two-piece display compartment/housing 33, having an upper compartment 33*a* and a lower compartment 33*b*. Coupled to upper compartment 33*a* is a display 35 and a button assembly 37. Display 35 is inset within upper compartment 33*a* and angled in a relatively upward angle toward the user while unit 13 is resting on a surface. Unit 13 is configured to display messages and/or notifications on display 35. When unit 13 is resting on the ground, display 35 is configured to project messages sufficient for the user to read and/or identify. In the preferred embodiment, display 35 is viewable without backlight. Display 35 is configured to mount directly to a PCB without an additional connector. As seen in the figures, display 35 is an LCD (liquid crystal display). It is understood that other types of displays are contemplated and considered viable alternatives.

Like unto display 35, button assembly 37 is inset into housing 31. The inset provides an aesthetic appeal. Button assembly 37 is configured to turn on and/or turn off base unit 13. In the preferred embodiment, base unit 13 is configured to have no true "off" setting, relying on a sleep mode or standby setting. In this configuration, button assembly 37 is used to awaken base unit from sleep mode. This allows base unit 13 to avoid power sequencing required between on and off states. In alternative configurations having an "off" state, base unit 13 is configured such that in the event unit 13 is not turned off, unit 13 will enter into a low-power mode (sleep mode). In either type of configuration, with an "off" or without an "off", base unit 13 is configured to use a time delay function to switch between full power to sleep mode. For example, display assembly 17 may switch to sleep mode after 10 min. In some embodiments, a user is able to adjust the time delay function duration.

Figure 7:
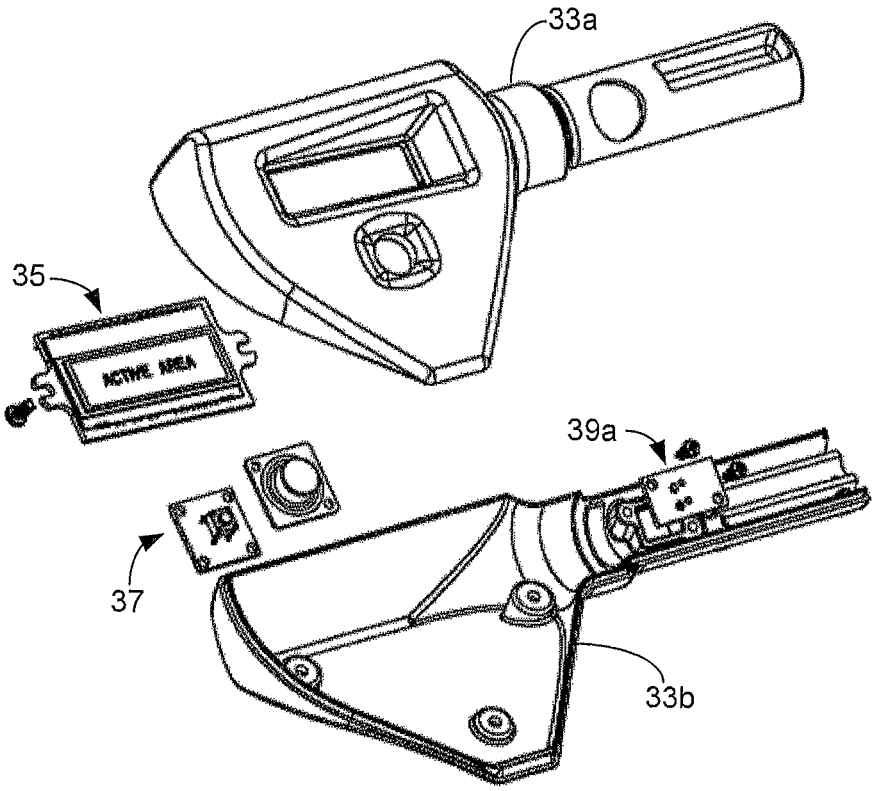
FIG. 7 is an exploded view of the display assembly of FIG. 4.
Figure 8:
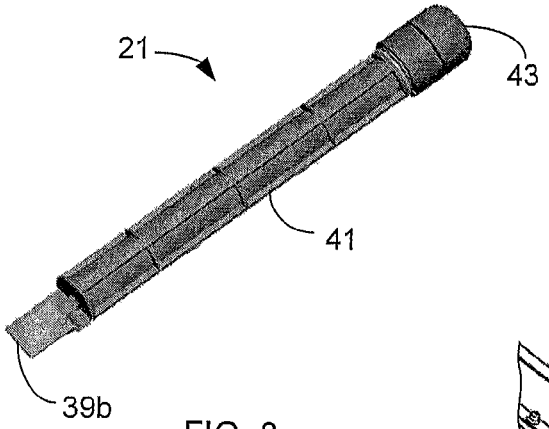
FIG. 8 is a perspective view of a battery unit in the base unit of FIG. 1.
Figure 9:
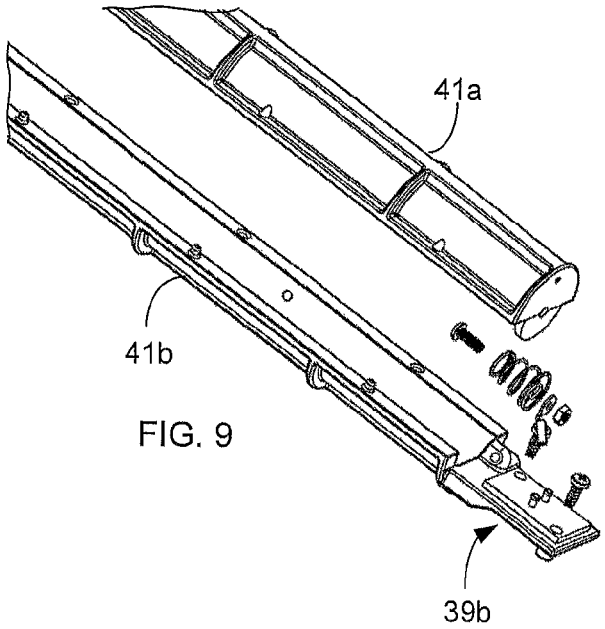
FIG. 9 is an exploded view of a first portion of the battery unit of FIG. 8.
Figure 10:
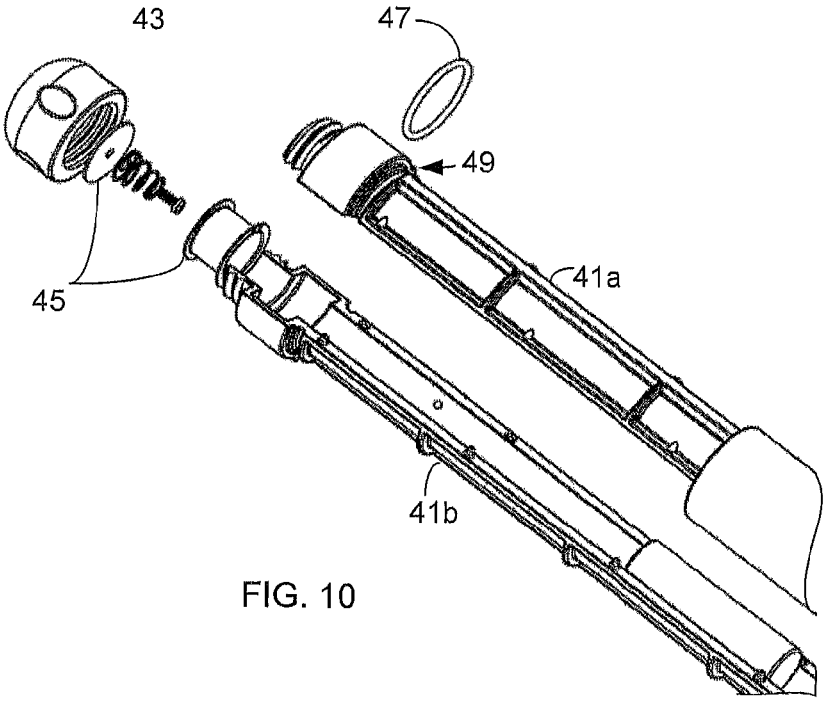
FIG. 10 is an exploded view of a second portion of the battery unit of FIG. 8.

As seen in particular with FIG. 7, display assembly 17 also includes a sensor board 39*a*. Sensor board 39*a* is housed within display compartment 33. Sensor board 39*a* is used in conjunction with a second sensor board for receiving and/or transmitting signals to and from sensory unit 15. It is understood that other electronic equipment may be included within display compartment 33 to assist in the electronic functions and calculations of unit 13. Such electronics may be associated within display 35, sensor board 39*a*, and/or button assembly 37.

Figure 6:
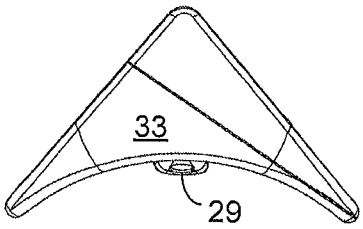
FIG. 6 is a side view of the display assembly of FIG. 4.

As seen in FIG. 6, display compartment 33 has a relatively triangular shape. Bottom portions of display compartment 33 act as legs, elevating housing 29. It is understood that housing 29 may include further legs at an end adjacent battery unit 21. Such additional legs may be interchangeable and/or deployable.

Referring now also to FIGS. 8-11 in the drawings, battery unit 21 is illustrated. Battery unit 21 is configured to house and store a power source used to power base unit 13. An example of a power source is a battery. Battery unit 21 is configured to accept conventional off-the-shelf batteries (one time use and/or rechargeable). Other types of batteries are possible. Battery unit 21 is capable of providing 550 mV of power which is sufficient to generate at least 600 two-minute uses. Furthermore, battery unit is configured to provide sufficient power in sleep mode to last at least one year. It is understood that modifications to the size and types of batteries used in battery unit 21 may be made to affect the duration, power level, and/or the number of uses. Such values are considered exemplary and are in no way limiting.

Battery unit 21 includes a battery compartment 41 having an upper compartment 41*a* and a lower compartment 41*b*. Upper and lower compartments 41*a*, 41*b* are combined to house the internal parts of battery unit 21. Battery unit 21 further includes a cap 43, battery contacts 45, and a seal 47. Seal 47 is located adjacent cap 43 within a groove 49 on compartment 41. Seal 47 is configured to seal against compartment 41 and an internal surface of housing 29. Seal provides a barrier to prevent foreign substances external to housing 29 from entering inside housing 29 (e.g., water, dirt, grass, dust).

Cap 43 threadedly couples to an end of compartment 41, being secured by interference fit. Compartment 41 houses one or more batteries. Other types of connections are contemplated. Cap 43 is configured to enclose the interior of compartment 41 from foreign substances. Battery contacts 45 are adjacent cap 43. Batteries are interchangeable. Additionally, other embodiments may include the ability to optionally plug-in base unit 13 to an AC-to-DC power supply.

Figure 4:
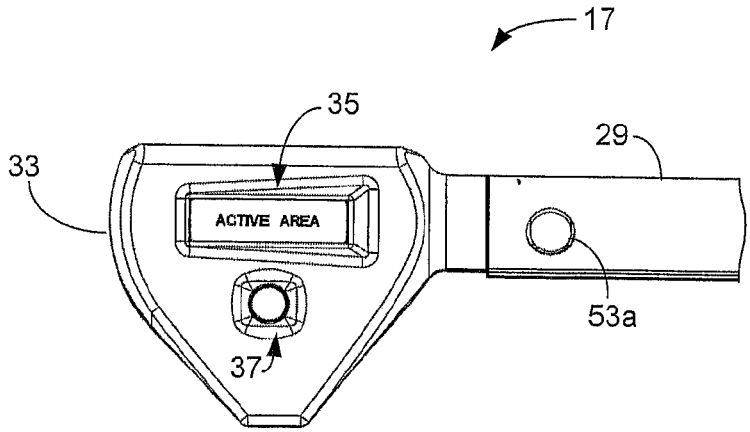
FIG. 4 is a front view of a display assembly on the base unit of FIG. 1.
Figure 5:
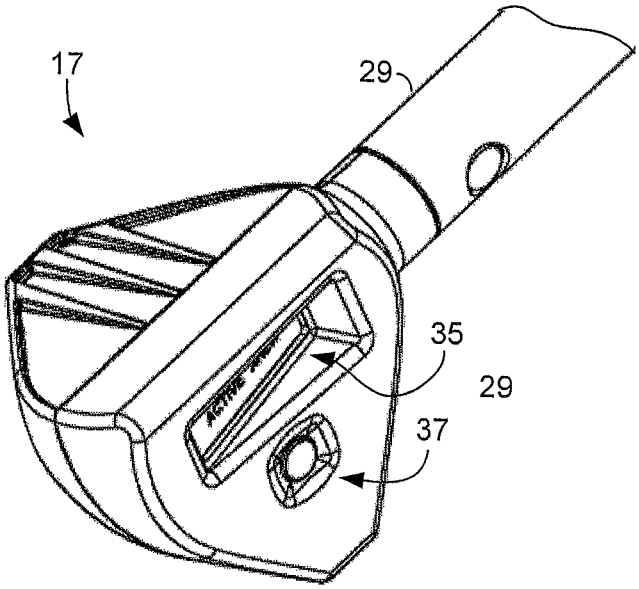
FIG. 5 is a perspective view of the display assembly of FIG. 4.
Figure 11:
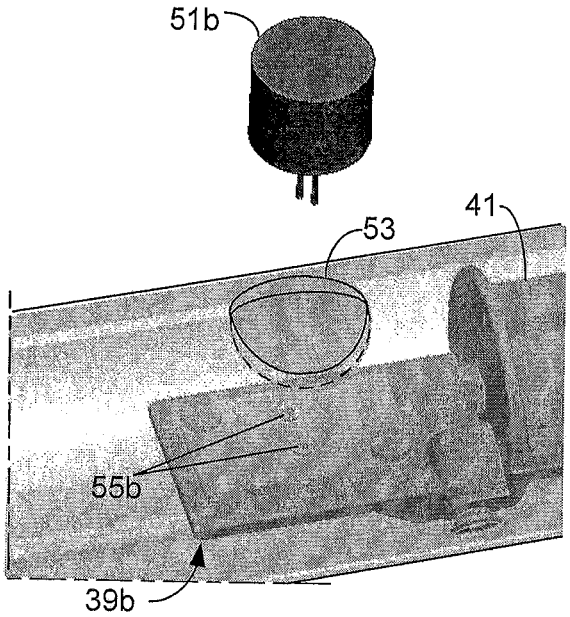
FIG. 11 an exploded view of a transducer and sensor board used with the battery unit of FIG. 8.

Battery unit 21 also includes a second sensor board 39*b* coupled to an end opposite cap 43. Sensor board 39*b* is configured to operate with sensor board 39*a*. Referring now also to FIG. 11, an exploded view of sensor board 39*b* is illustrated. Sensor board 39*a* and 39*b* are configured to receive a sensor 51*a*, 51*b* respectively. Description of sensor 51*b* will apply to that of sensor 51*a*. Sensor 51*b* is a transducer in the preferred embodiment and is external to housing 29. Sensor 51*b* is inserted through aperture 53 in housing 29 and coupled to sensor board 39*b* via a sensor socket 55*b*. A similar aperture 53*a* is illustrated in FIG. 4. Sensor 51*b* is potted in place to provide for weather sealing. Sensor 51*a* and 51*b* are located adjacent to opposing ends of housing 29. The locations of sensors 51*a* and 51*b* assist in calculating the alignment of the user with base unit 13. It is preferred that sensors 51*a*, 51*b*, and 27 are bidirectional transducers to both receive and transmit a signal.

Figure 12:
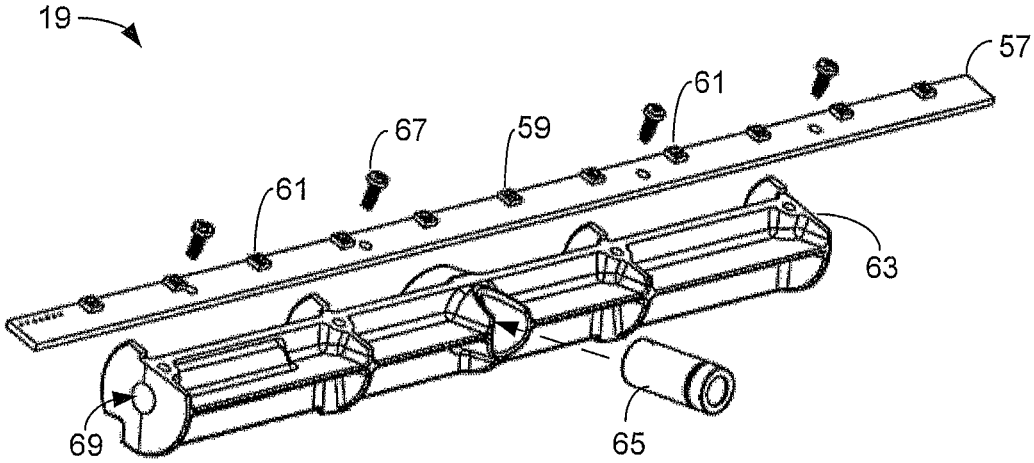
FIG. 12 is a perspective view of an indicator assembly in the base unit of FIG. 1.
Figure 13:
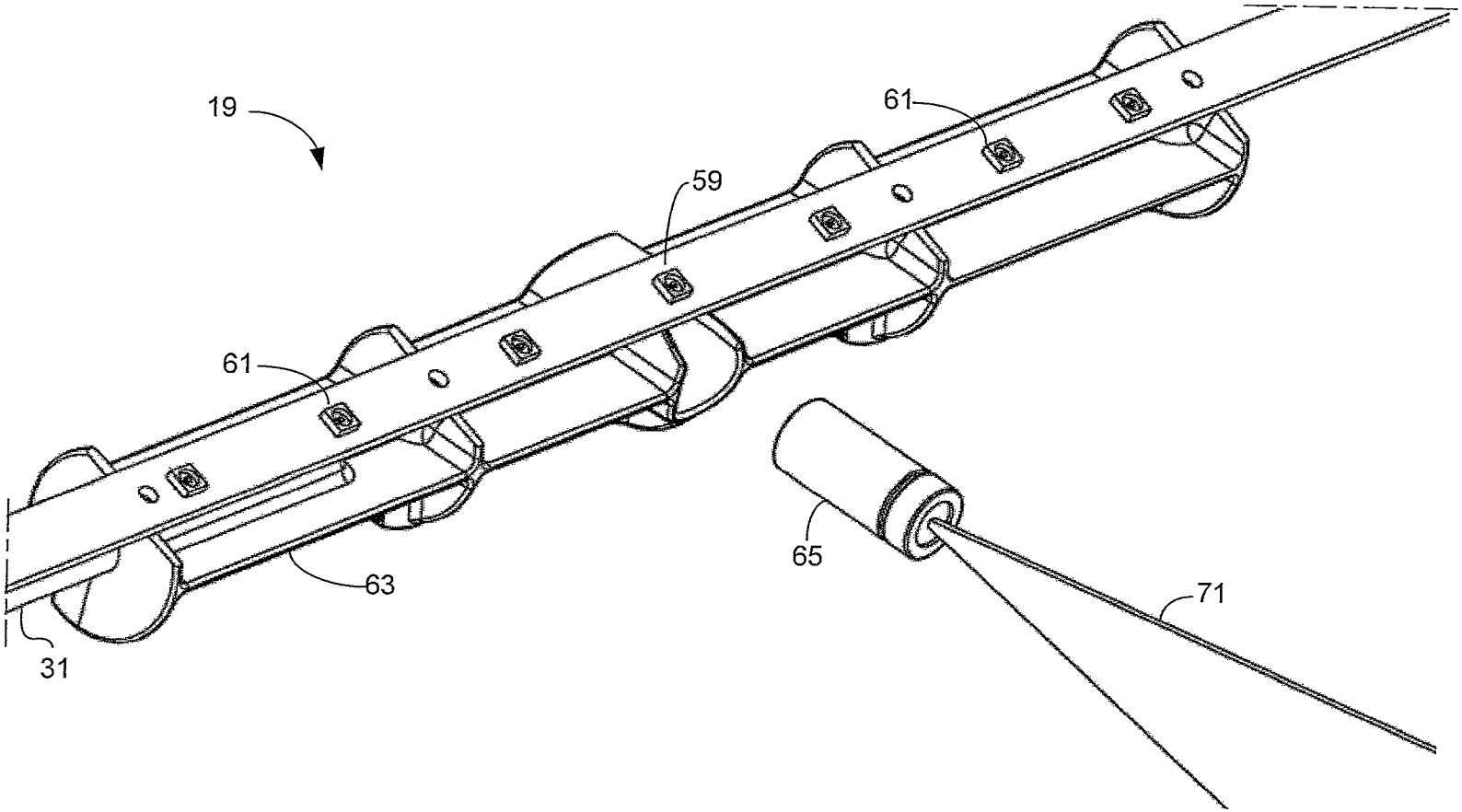
FIG. 13 is a perspective view of a central indicator used in the indicator assembly of FIG. 12.

Referring now also to FIGS. 12 and 13 in the drawings, indicator assembly 19 is illustrated. Indicator assembly 19 is configured to provide sensory data to the user with respect to the user's alignment with base unit 13. In the preferred embodiment, indicator assembly 19 includes an LED board 57 having a total of eleven separate LED lights. Board 57 provides the primary user interface in training device 10. The light in the center is termed the center light 59. The remaining lights are outboard lights 61. In the preferred embodiment, center light is colored a distinct color (e.g., green) and is used to indicate a parallel alignment of the user with base unit 13. Outboard lights 61 are spaced equally on opposing sides of center light 59. Outboard lights 61 are colored differently (e.g., red) from that of center light 59 and are used to show the degree to which the user is out of alignment with base unit 13. By having outboard lights 61 arranged on opposing sides of center light 59, an incorrect alignment in either direction will be indicated to the user.

It is understood that the colors disclosed are in no way limiting and serve as exemplary color choices. Additionally, other embodiments may use one or more LEDs 59, 61 different from that specified above. Likewise, it is understood that LED lighting is only one type of indicator that may be used to notify the user of alignment. Device 10 may use any type of lighting device in assembly 19. Any indicator may be used providing such indicator is able to provide an indication when the user is aligned with base unit 13 and can indicate the degree to which the user is out of alignment.

Board 57 is coupled to a support 63 via one or more fasteners 67. Support 63 includes a channel 69 to house bar 31. Additionally, support 63 includes a socket to house a central indicator. A central indicator may be a laser 65. Laser 65 is configured to produce a beam 71 perpendicular to the central axis of housing 29. User is able to center about beam 71, Beam 71 is configured to be visible in sunlight and not to be harmful to the eyes of the user. Additionally, beam 71 is configured to project away from base unit 13 a selected distance, for example, 10 feet to allow sufficient room for the user to approach the ball.

Some additional features of base unit 13 are as follows. Unit 13 can be configured to have a debugging interface that contains the processor programming pins and serial port. Although it is not intended for the user to be able to debug potential problems, it is contemplated that such a feature is possible. Additionally, unit 13 and unit 15 are both designed such that no active cooling is required and are comfortable to touch during normal operations. Furthermore, indicator assembly 19 is configured to indicate "low battery" state and an "active" state of device 10. Furthermore, assembly 19 is configured to notify the user concerning the connectivity between unit 13 and unit 15. If unit 13 is searching for unit 15 (no signals identified from unit 15), an activity light may blink at a slow rate. If the activity light blinks at a fast rate, then a user is notified that only a partial signal from unit 15 is received. If signals from both sensors 27 on unit 15 are received, then the activity light may be solid.

Referring back to FIG. 2, sensory unit 15 is configured to transmit position data related to the user to base unit 13. Sensors 27 are preferably bidirectional transducers that receive and emit ultrasonic signals. It is contemplated that other types of sensors may be used. Sensors 27 are located on the front of a user, preferably on opposing sides of the user. A distance of eight inches is preferred between each sensor 27; however, it is not required.

Unit 15 further includes a battery unit and electronics 25. Battery unit 25 stores one or more batteries used to power the electronics and sensors within unit 15. Battery unit 25 is similar to that of battery unit 21 in the types of batteries and the optional ability of a plug-in feature. Electronics 25 are in communication with battery unit 25 for receiving power and for operating sensors 27. Electronics 25 includes hardware and software to automatically communicate with base unit 13. A power button is included with unit 15. The features and limitations of power button 73 are similar to that of button assembly 37.

Figure 14:
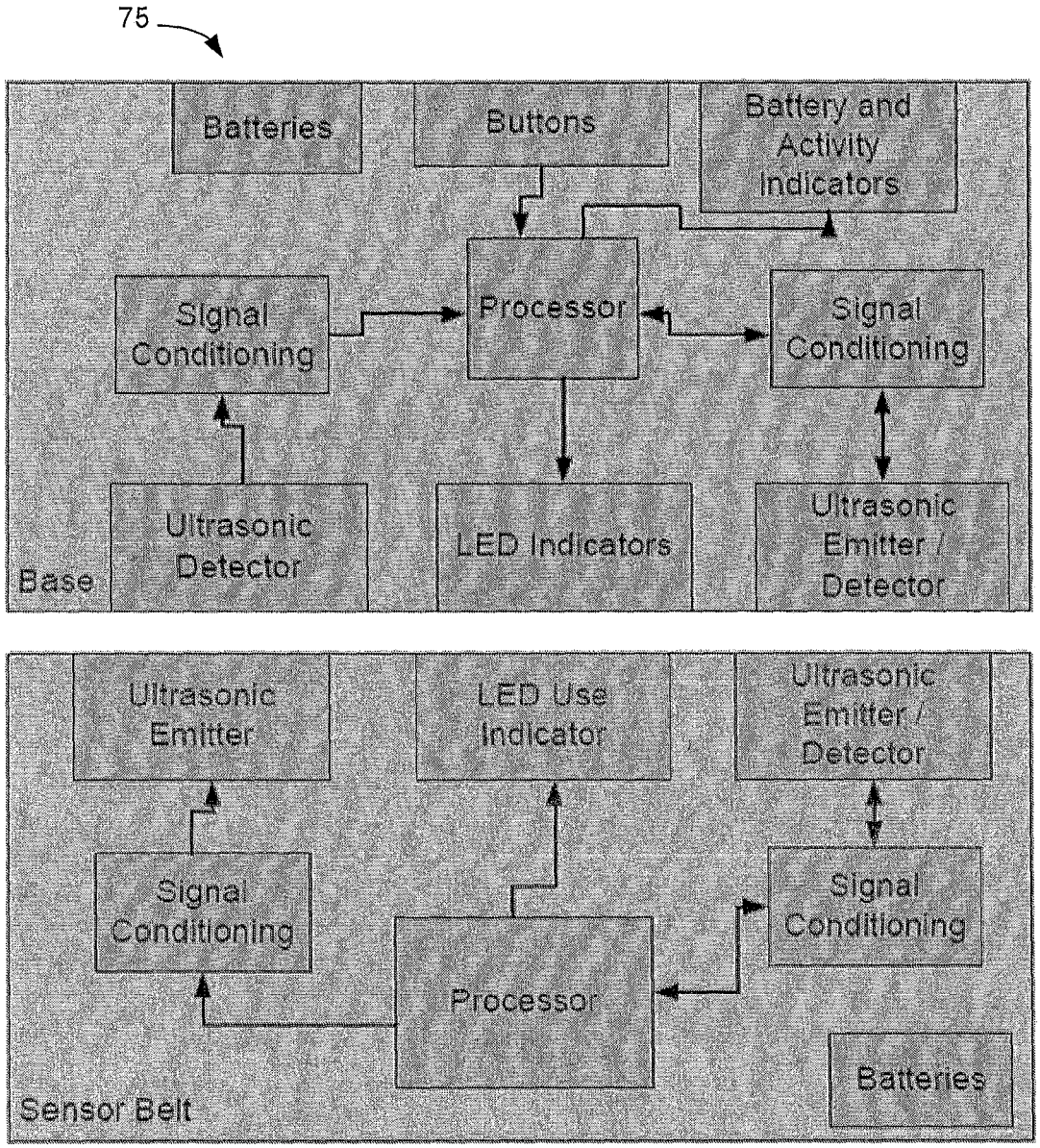
FIG. 14 is an electrical block diagram between the base unit of FIG. 1 and the sensory unit of FIG. 2.

Referring now also to FIG. 14, an electrical block diagram 75 between unit 13 and unit 15 is illustrated. Unit 13 and unit 15 communicate between each other with ultrasonic pulses in the preferred embodiment. Each unit 13, 15 is powered by independent power sources 21, 23. FIG. 14 illustrates a basic electrical block diagram for base unit 13 in communication with sensory unit 15.

Signals transmitted and received between units 13 and 15 are processed within each unit 13 and 15. Teaching device 10 uses one or more algorithms located in electronics 25 and/or the electronics of base unit 13 to process and communicate data. In the preferred embodiment, one of two algorithms may be used: a baseline variant and/or an enhanced variant. The baseline variant is capable of resolving user alignment when the user is centered about the base unit 13. The enhanced variant enables training device 10 to resolve both the alignment of the user and the translation of the user off of the central indicator. Training device includes the baseline variant but may also optionally include the enhanced variant. A user may be able to selectively switch between variants in alternative embodiments. It is understood that training device 10 has the ability to adapt to various types of stances depending on the type of swing a user needs to make (i.e. where a stance needs to be more open).

Figure 15:
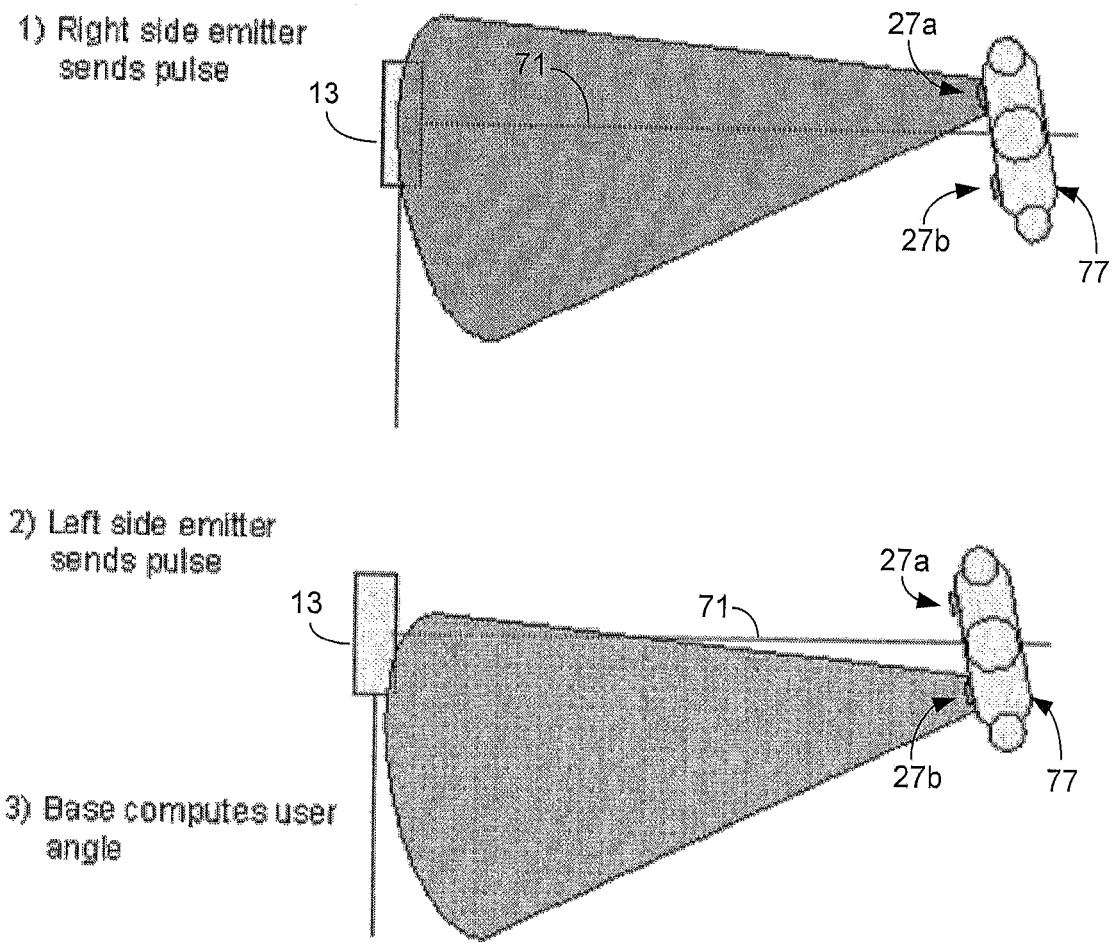
FIGS. 15 and 16 are representations of the operation of a baseline variant and an enhanced variant of the base unit of FIG. 1 in communication with the sensory unit of FIG. 2.
Figure 16:
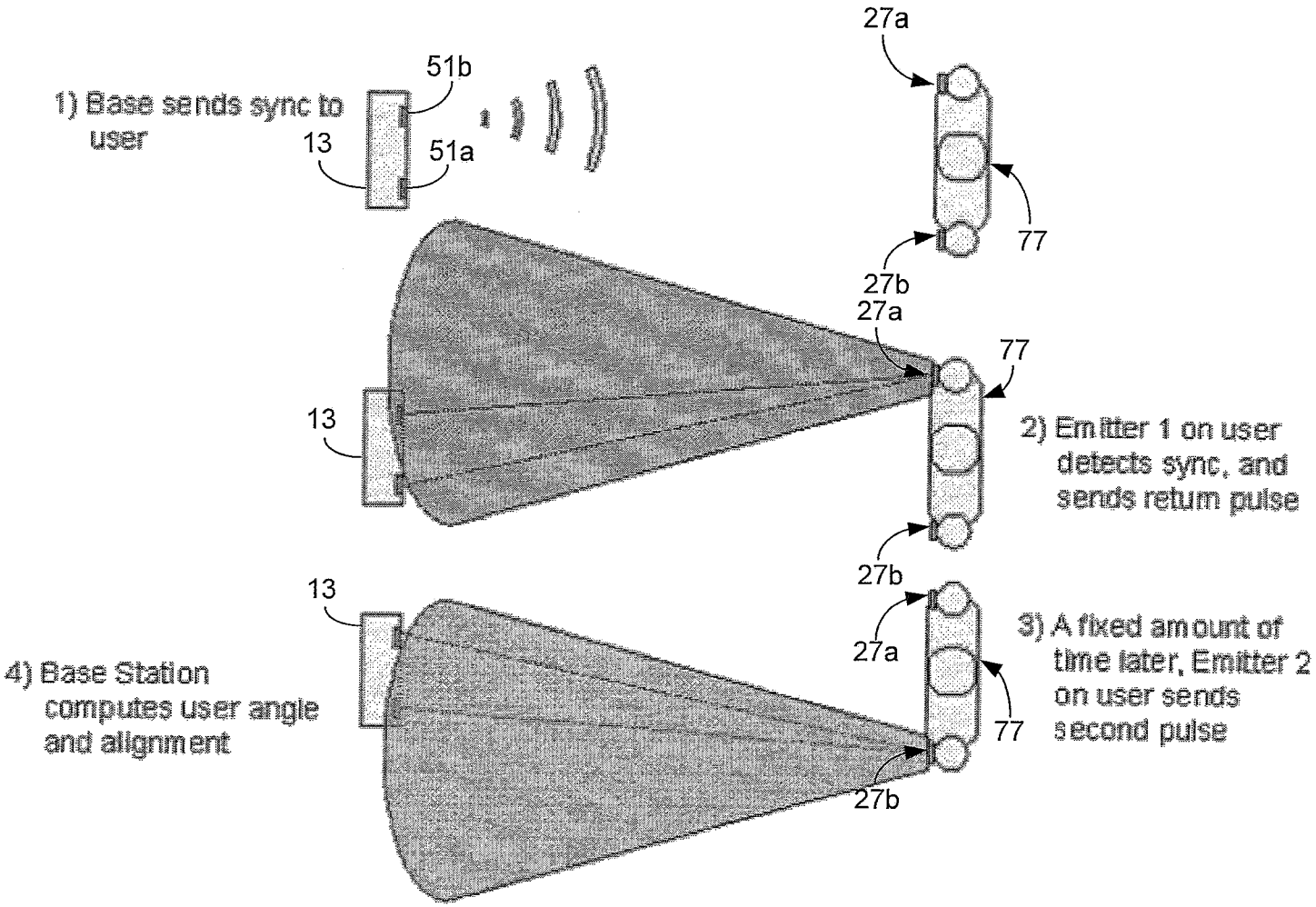

Referring now also to FIGS. 15 and 16 in the drawings, illustrated representations of the operation of the baseline variant and the enhanced variant are shown. FIG. 14 illustrates the operation of the baseline variant. First a first sensor 27*a* (similar to that of sensors 27) emits an ultrasonic pulse to base unit 13. Second, a second sensor 27*b* emits an ultrasonic pulse to base unit 13. Thirdly, base unit process the positional data from sensors 27*a*, 27*b* to compute the alignment of the user. Note that the user 77 is centered about center indicator, beam 71.

As seen in FIG. 16, the operation of the enhanced variant is illustrated. First, unit 13 sends a signal to unit 15. Second, unit 15 detects the signal from unit 13 and then sends return ultrasonic pulse from first sensor 27*a* to base unit 13. Third, second sensor 27*b* emits an ultrasonic pulse to base unit 13 after a preselected time delay. Fourth, base unit 13 processes the data from sensors 27*a*, 27*b* to compute the alignment and the angle of user 77. The ultrasonic pulses from sensors 27*a* and 27*b* are received by both sensors 51*a*, 51*b*.

Figure 17:
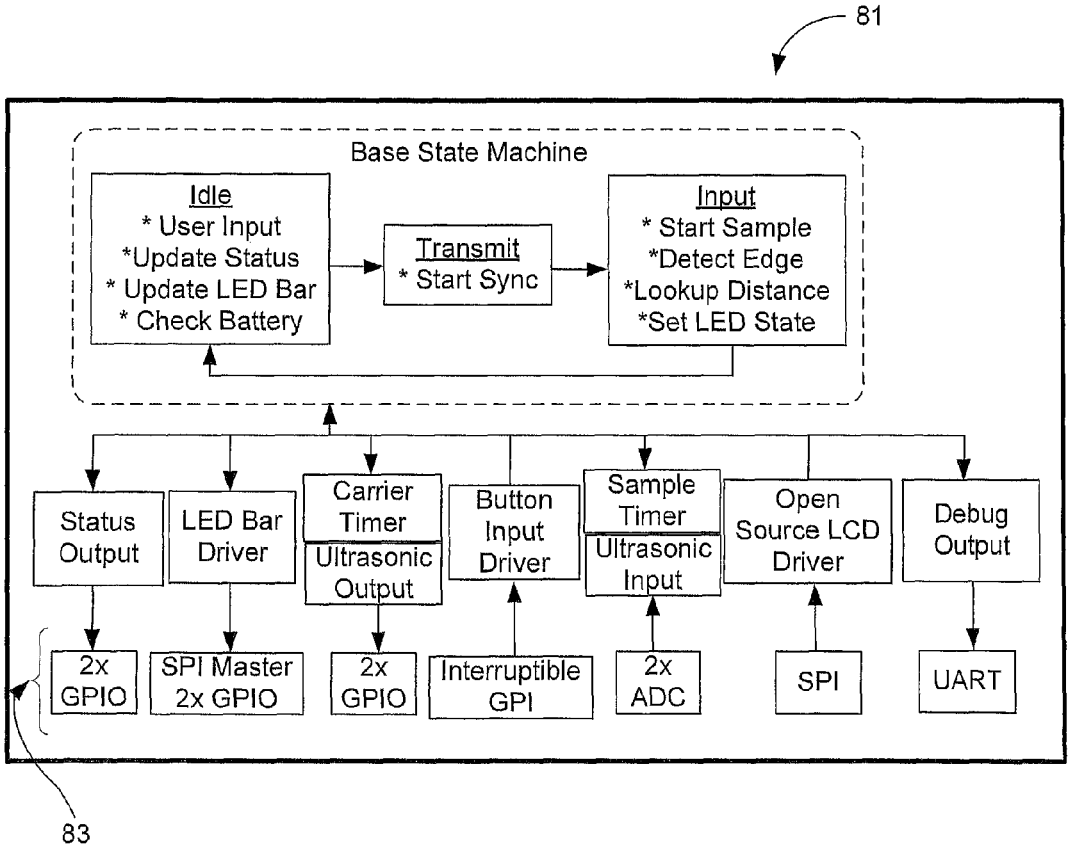
FIGS. 17 and 18 are software block diagrams of the base unit of FIG. 1 and the sensory unit of FIG. 2.
Figure 18:
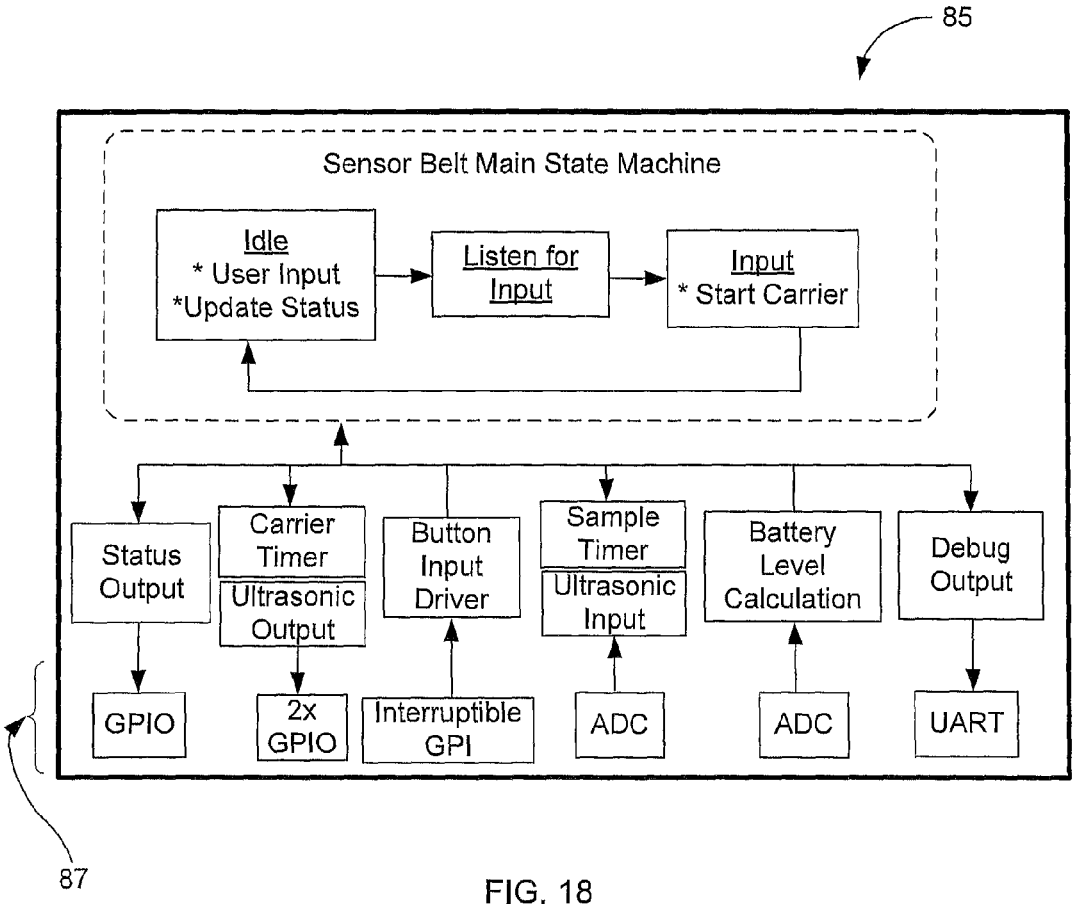

Referring now also to FIGS. 17 and 18 in the drawings, software block diagrams of base unit 13 (FIG. 17) and sensory unit 15 (FIG. 18) are illustrated. Software in base unit 13 is responsible for sensing and estimating the alignment of user 77 and controlling the indicators. Diagram 81 represents the software block diagram for unit 13. All elements are part of the baseline software variant except as noted herein. Elements along row 83 pertain to external interfaces. Diagram 85 represents the software block diagram for unit 15. All elements are part of the baseline software variant except as noted herein. Elements along row 87 pertain to external interfaces. Furthermore, both "carrier timer" and "sample timer" in diagrams 81 and 85 apply to the category of a fast timer ISR.

Some additional features to note are the ability of training device 10 to indicate the distance to the reference location. Additionally, training device 10 may also be configured to notify the user of environmental weather conditions, notably: temperature, wind speed, and humidity for example. Such notifications may be made by the display assembly 17. Furthermore, training device 10 may be configured to notify the user of distance to the reference location and/or distance to the hole.

In order to orient the stance of a user to the reference location, base unit 13 needs to be aligned with a selected reference location. The user is then to orient himself/herself with base unit 13. Preferably a user may stand anywhere between 4 and 10 feet from base unit 13. Base unit 13 and sensory unit 15 communicate via ultrasonic signals in either a baseline variant or an enhanced variant. Position data of the user is calculated/processed, and training device indicates to the user the relative alignment with the base unit 13. The process of calculating the alignment and/or angle or translation is preferably done continuously, such that a user may recognize misalignments and correct them in real time and have instantaneous feedback until a proper alignment is achieved.

Referring now to FIGS. 19 through 26, a training device 89 is illustrated. Training device 89 includes a base unit 91 configured to receive infrared (IR) signals emitted from a belt unit 93 in order to assist a golfer in properly aligning a stance with a reference location, such as a hole in a golf course. Base unit 91 houses hardware and software used to calculate the user's alignment with respect to base unit 91 as well as hardware and software used to display such alignment to the user.

Base unit 91 has a similar configuration to base unit 13 (described above) and includes a display assembly 17, an indicator assembly 95, and a battery unit 21. Base unit 91 is configured to provide sensory feedback to the user regarding user alignment with base unit 91. The sensory feedback may be performed through use of a display, visual indicators, and/or audible indicators. A user is able to correct such alignment and receive relatively instantaneous feedback of the adjusted alignment. Both display assembly 17 and indicator assembly 95 are configured to provide sensory feedback to the user.

As with base unit 13, base unit 91 is configured to be transportable by the user form location to location. In the preferred embodiment, unit 91 is used to assist a user in properly aligning themselves with a hole on a golf course when approaching the ball. Therefore, unit 91 is sized to be accessible and carried within a conventional golf bag. While not in a transportation carrying case, unit 91 is configured to rest in contact with the ground and aligned to a reference location in the same manner as base unit 13. Embodiments may include fixed, interchangeable, or deployable protrusions, such as legs for example. Unit 91 may also rest on an exterior surface being elevated to some degree from the surface of the ground in alternative embodiments.

Figure 19:
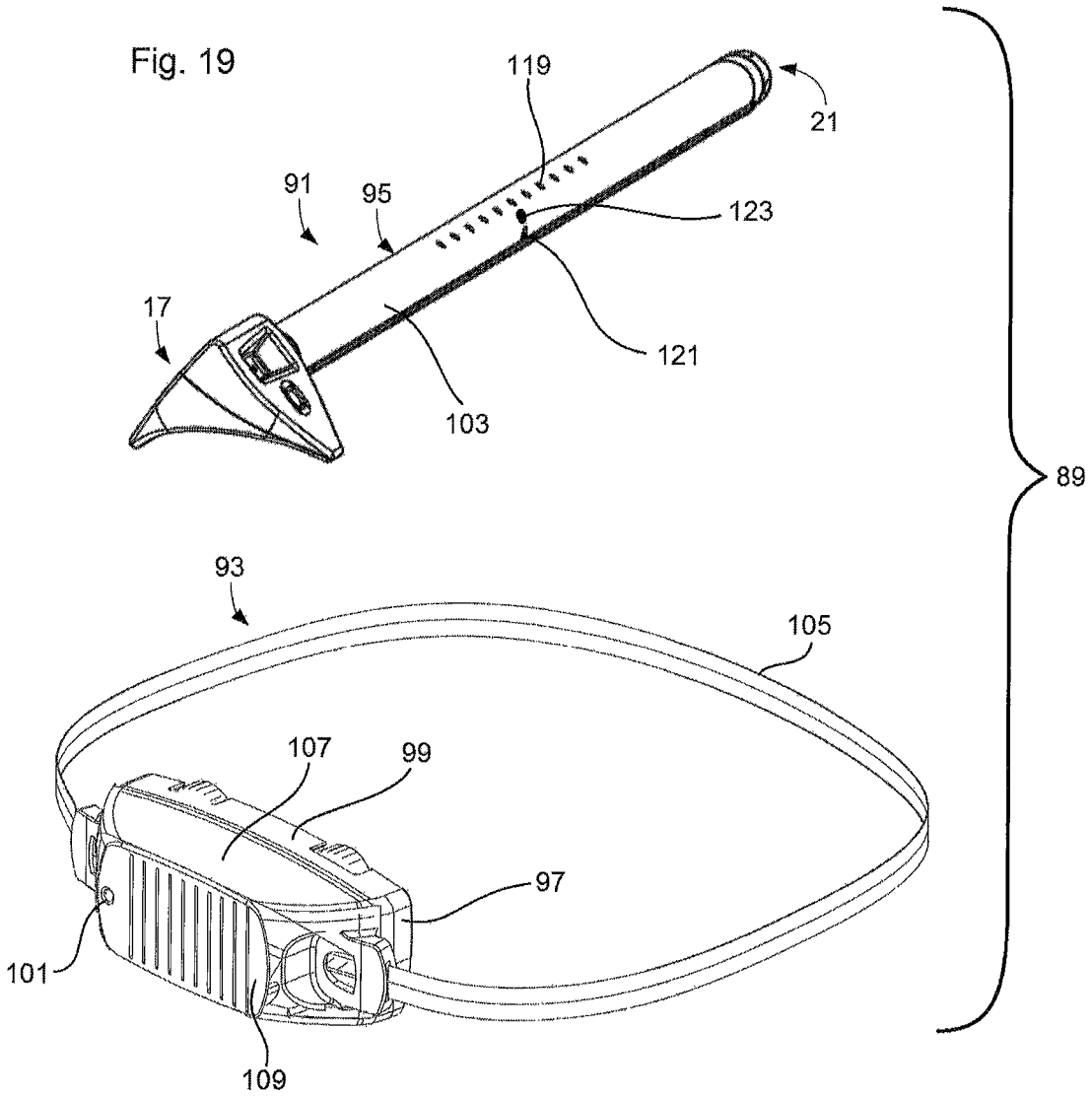
FIG. 19 is a perspective view of a base unit and a belt unit in a training device according to another embodiment of the present application.

Belt unit 93 includes a battery unit 97, electronics 99 (hardware and software), and IR emitters 101. Electronics 99 regulate the operations of belt unit 93. Belt unit 93 is configured to emit IR signals that are detected by a sensor on base unit 91, selectively emitting signals from emitters 101 to base unit 91. Emitters 101 are IR light-emitting diode (LED) emitters in the preferred embodiment, however, it is understood that emitters 101 may be other wireless types of emitters suitable for wireless communication, for example, radio frequency (RF), laser, or another type of emitter suitable for application to device 89. In the preferred embodiment, emitters 101 are coupled to portions of the body of the user for movement with the body of the user. For example, belt unit 93 may be configured as a belt, as shown in FIG. 19, wherein emitters 101 are positioned at a central portion of the user. Belt unit 93 is adjustable to suit the size of the user. For example, where unit 93 is a belt, the belt size may be adjustable (e.g., 24-28 inches).

Although specific dimensions have been disclosed, it is understood that unit 91 is not limited to those specific dimensions. It is understood that unit 91 may be used in other applications outside of golf, and as such, dimensioning of unit 91 may vary in accordance with each application.

Belt unit 93 comprises a strap 105 and a belt housing 107. Strap 105 is connected to housing 107, so that they cooperate to form a circumferential belt that encircles the user at approximately the waist and locates belt housing 107 in approximately the front center of the user. Housing 107 has a front cover 109 and contains battery 97 and electronics 99.

Figure 20:
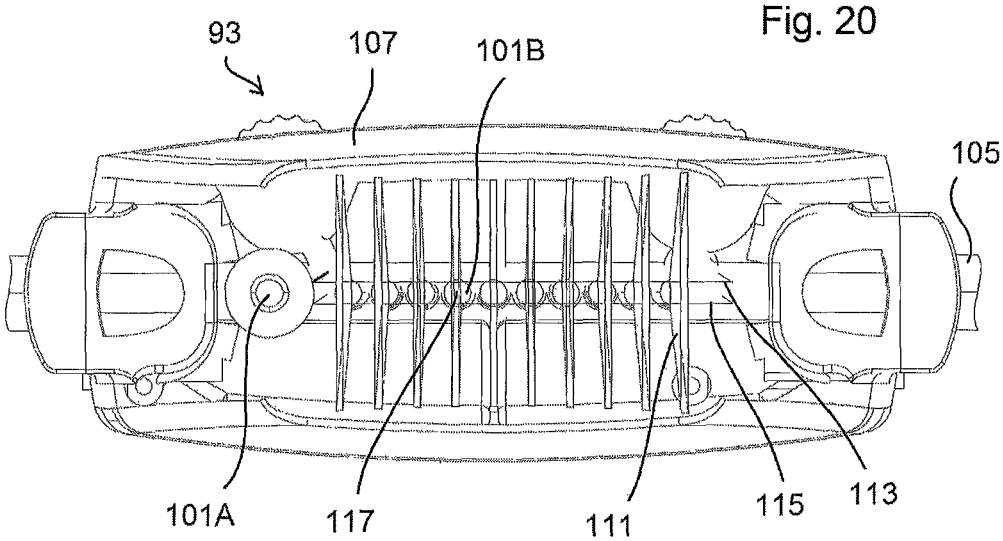
FIG. 20 is an enlarged front view of the belt unit of FIG. 19, a front cover having been removed.
Figure 21:
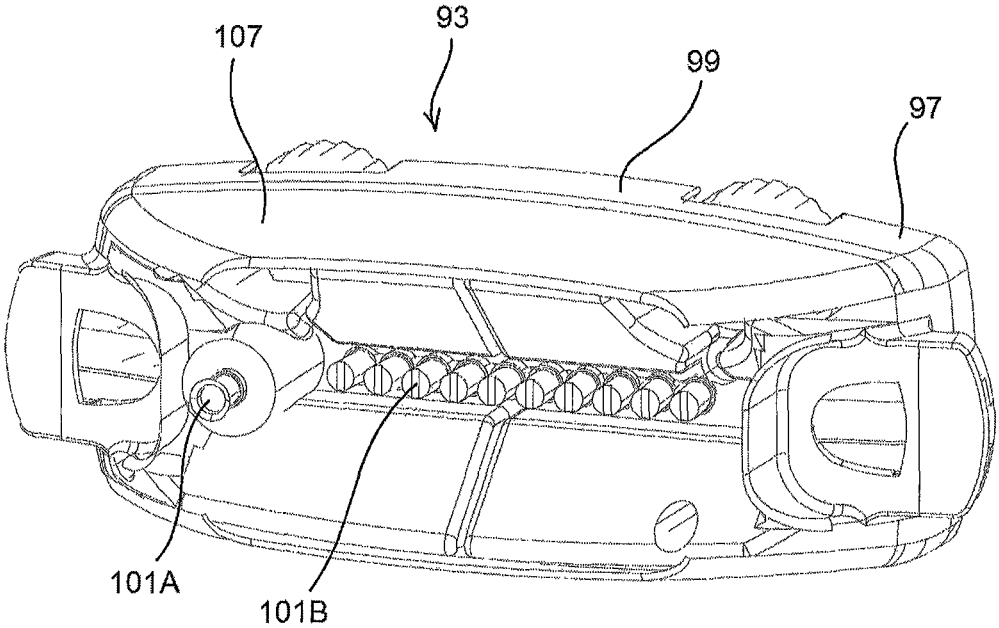
FIG. 21 is an enlarged oblique view of the belt unit of FIG. 19, a front cover and guides having been removed.

Referring now specifically to FIGS. 20 and 21, electronics 99 control IR LED emitters 101, which are divided into sync emitter 101A and position emitters 101B. Portions of housing 107 are shown removed in FIGS. 20 and 21 for ease of viewing. Belt unit 93 comprises eleven emitters 101: one sync emitter 101A, and ten position emitters 101B. As shown in the figures, sync emitter 101A is located in a forward portion of housing 107 and extends through cover 109, permitting sync emitter 101A to have a wide field of view. Position emitters 101B are located in a rear portion of housing 107 and are seen more easily in FIG. 21. In the present embodiment, emitters 101A, 101B emit IR light at a wavelength of 950 nm, though emitters of other wavelengths may be used. In the present embodiment, position emitters 101B are arranged along an arc of radius 29.62 inches, spaced 0.26 inches apart, resulting in each emitter pointing one degree away from adjacent emitters 101B. In order to limit the viewing angle of each emitter 101B to about five degrees along the arc, pairs of vertical guides 111 and horizontal guides 113, 115 are located in the beam path of emitters 101B. Vertical guides 111 of each pair are closely spaced to each other and parallel to the radial lines of emission from the associated emitter 101B. Guides 111, 113, 115 intersect to form a grid having apertures 117 directly ahead of each emitter 101B. This creates a field of view, illuminated by all 101B emitters, that is fourteen degrees wide. The one-degree offset and five-degree viewing angle of each emitter allow an IR receiver within the field of view to simultaneously sense light emitted from up to five emitters 101B. Because sync emitter 101A is in the front portion of housing 107 and does not emit through a narrow aperture, emitter 101A may be observed anywhere within this field of view.

Referring again to FIG. 19, as mentioned above, base unit 91 is constructed like base unit 13 (as shown in FIG. 3 and described above). However, base unit 91 has a housing 103 that differs in details from housing 29 of base unit 13. Housing 103 is tubular in nature, and battery unit 21 is coupled to housing 103 on an end opposite display assembly 17. Within housing 103 is locating bar 31 (as shown in FIG. 3), which is configured and serves the same purposes as described for base unit 13.

Housing 103 contains indicator assembly 95 in the same manner as housing 29 of base unit 13 contains indicator assembly 19. Assembly 93 is constructed and operates like indicator assembly 19 (shown in FIGS. 12 and 13 and described above). Indicator assembly 95 comprises an LED board having LEDs 119 and a central indicator, such as laser 121. Laser 121 is positioned and operates in the same manner as that described above for laser 65.

Housing 103 also contains IR receiver 123 that is tuned to detect IR light emitted at the wavelength of IR emitters 101A, 101B on belt unit 93. IR receiver 123 performs a similar receiving function as transducers 51A, 51B in base unit 13, but only one IR receiver 123 is used, and it is located in the longitudinal center of housing 103. IR receiver 123 is connected to the electronics of base unit 91 for transmitting to those electronics the signals generated by receiver 123 in response to IR detections.

Figure 22:
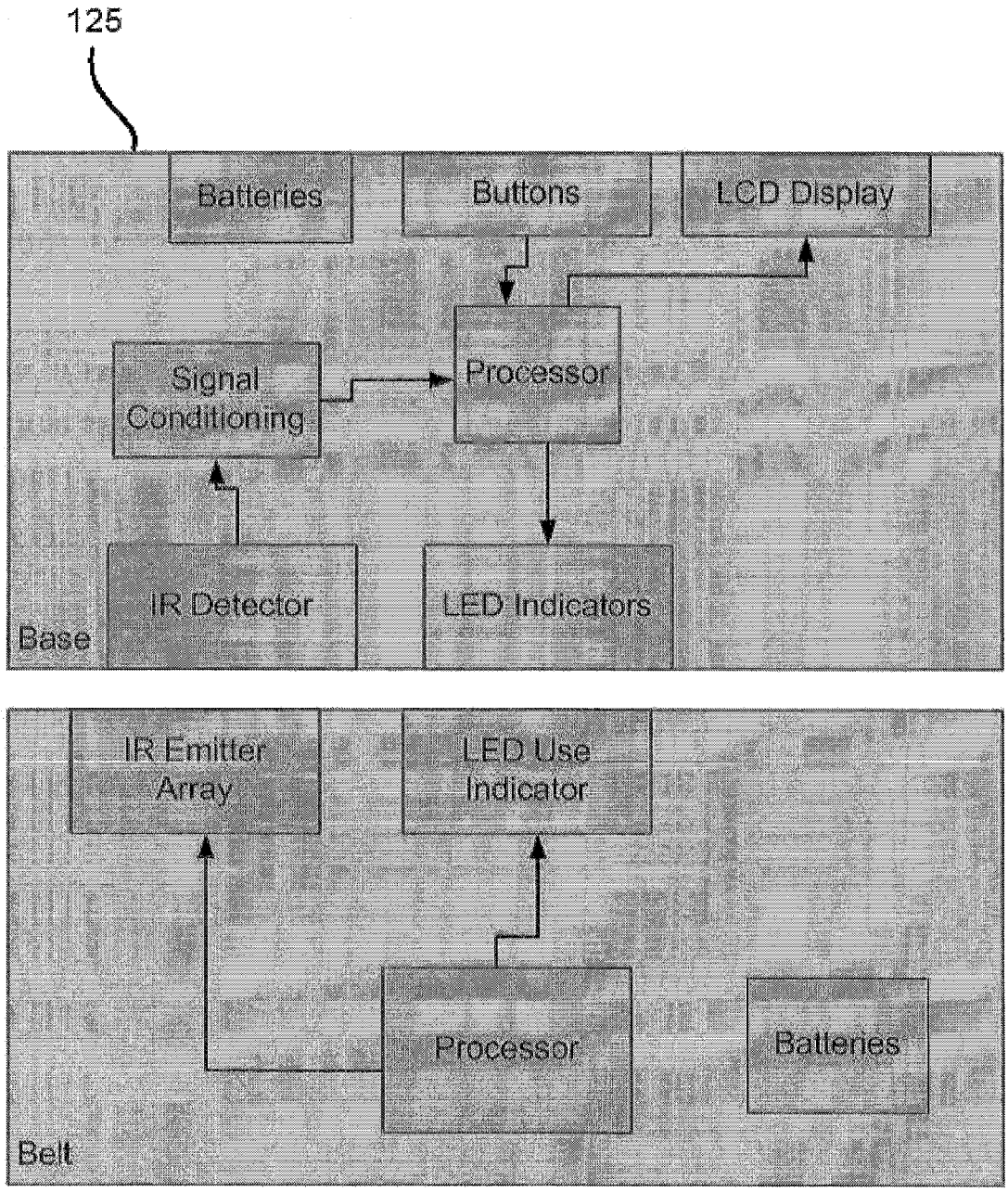
FIG. 22 is an electrical block diagram between the base unit and belt unit of FIG. 19.

Referring now to FIG. 22, an electrical block diagram 125 between unit 91 and unit 93 is illustrated. Base unit 91 receives IR signals from belt unit 93 in the preferred embodiment. Each unit 91, 93 is powered by independent power sources 21, 97.

Signals transmitted from unit 93 to unit 91 are received by unit 91. Teaching device 89 uses one or more algorithms located in the electronics of base unit 91 to process and communicate data. In the preferred embodiment, unit 91 is capable of resolving user alignment when the user is centered about base unit 91. The user centers about base unit 91 by aligning the centerline of the user with the line emitted by laser 121.

Figure 23:
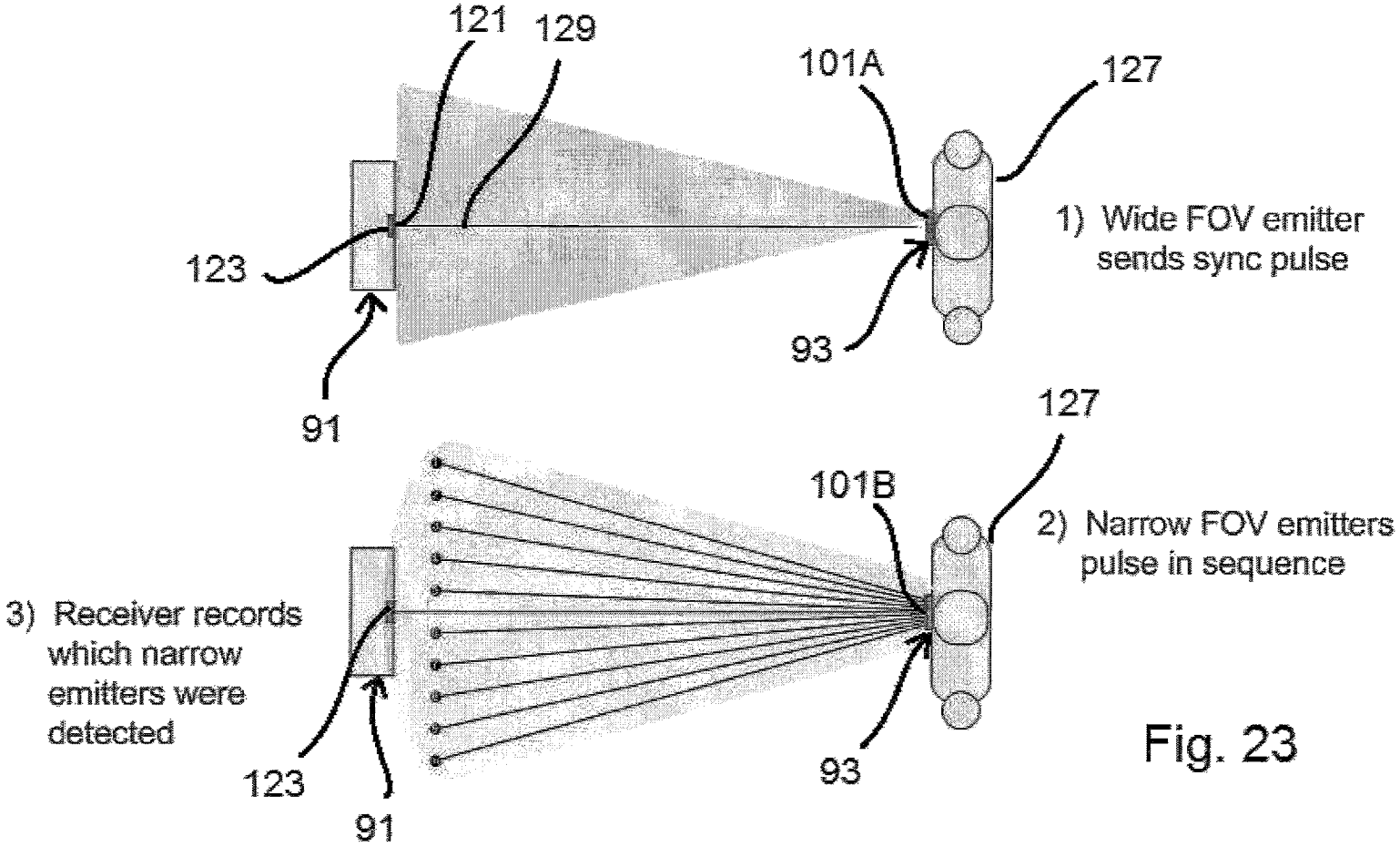
FIGS. 23 and 24 are representations of the operation of the base unit and the belt unit of FIG. 19.
Figure 24:
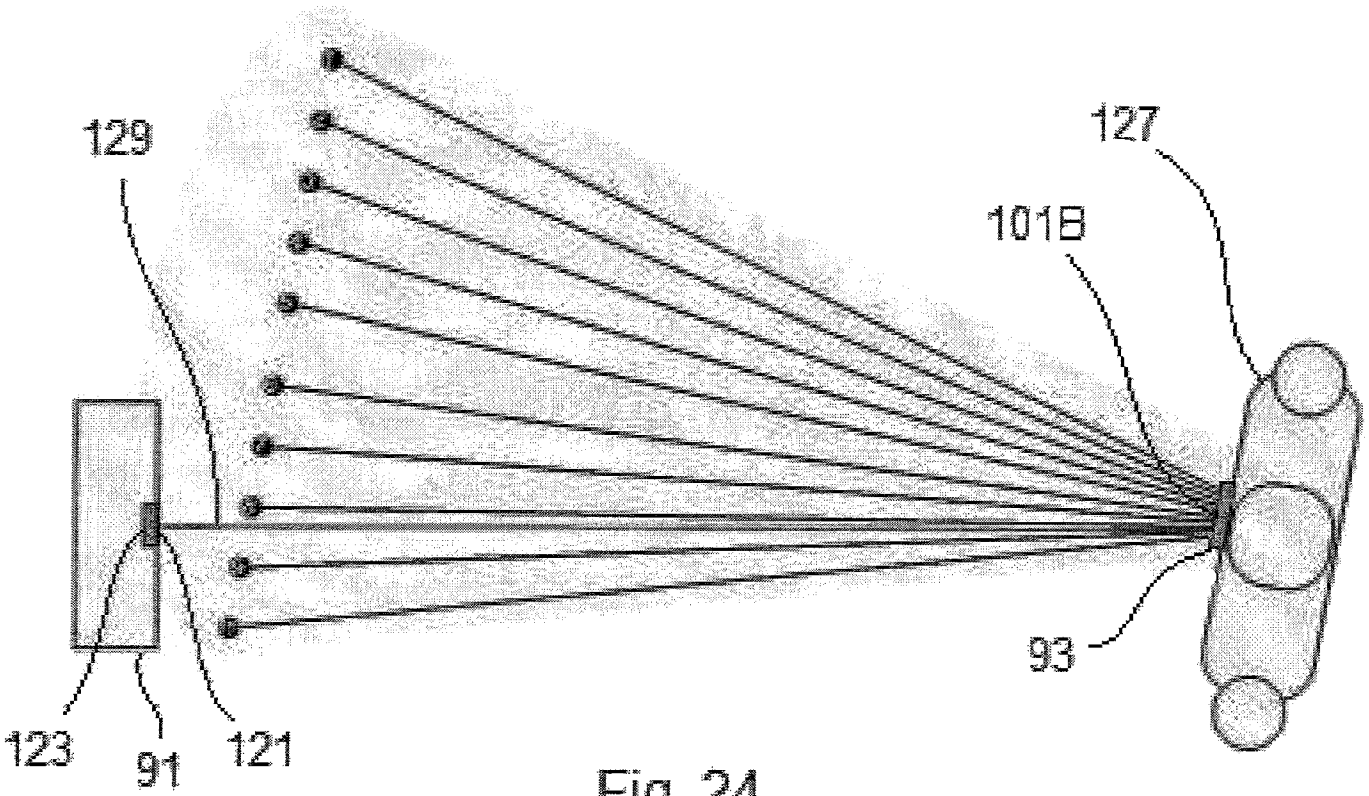

FIGS. 23 and 24 illustrate operation of device 89. A user 127 operates switches or otherwise powers up base unit 91, and then user 127 orients in longitudinal translation relative to base unit 91 about centerline 129 emitted by laser 121. The embedded software inside a microcontroller of electronics 99 of belt unit 93 controls the sequencing for each emitter 101A, 101B. Sync emitter 101A is pulsed first, for a period of 10 milliseconds (ms), and then all emitters 101A, 101B remain off for the next 2 ms. Then one at a time, starting with position emitter 101B closest to sync emitter 101A, each emitter 101B is pulsed for 5 ms, followed by another dark period of 2 ms. After 80 ms, each emitter 101A, 101B has been lit once and the cycle is complete. The process starts again after 20 ms, giving an effective 10 Hz system update rate.

Embedded software in a microcontroller of base unit 91 samples the digital output of IR receiver 123 once per millisecond. If the software records greater than five consecutive IR detections, then the software determines the detection must be the pulse from sync emitter 101A, and an internal state machine is started at the end of the pulse. Receiver 123 is then sampled in 7 ms windows for the following 70 ms. Each sample window corresponds to an angle, and if an IR pulse is detected within a particular sample window, then the angular orientation of belt unit 93 to base unit 91 must be within five degrees of the angle associated with that sample window. If two position emitters 101B are detected, then angle must lie in the resulting four degrees of overlap, and so on. Up to five position emitters 101B may be detected, resulting in a maximum of one degree precision. The system keeps a rolling average of ten complete cycles, and indicates this average to the user via indicator assembly 95 and display 35 of display assembly 17.

FIG. 24 illustrates the situation in which user 127 is centered about centerline 129 from laser 121, but user 127 and belt unit 93 are rotated relative to base unit 91. In this case, IR receiver 123 of base unit 91 will detect the narrow emissions from position emitters 101B located toward the left side of belt unit 93 and will not detect emissions from position emitters 101B toward the right side. The electronics of base unit 91 determine the angle of belt unit 93 correlating to which emitters 101B are detected and then displays the results to user 127. As user 127 changes the angle of alignment to correct the stance, base unit 91 updates the displayed results to indicate the angle correlating to the most recent detections of position emitters 101B.

Figure 25:
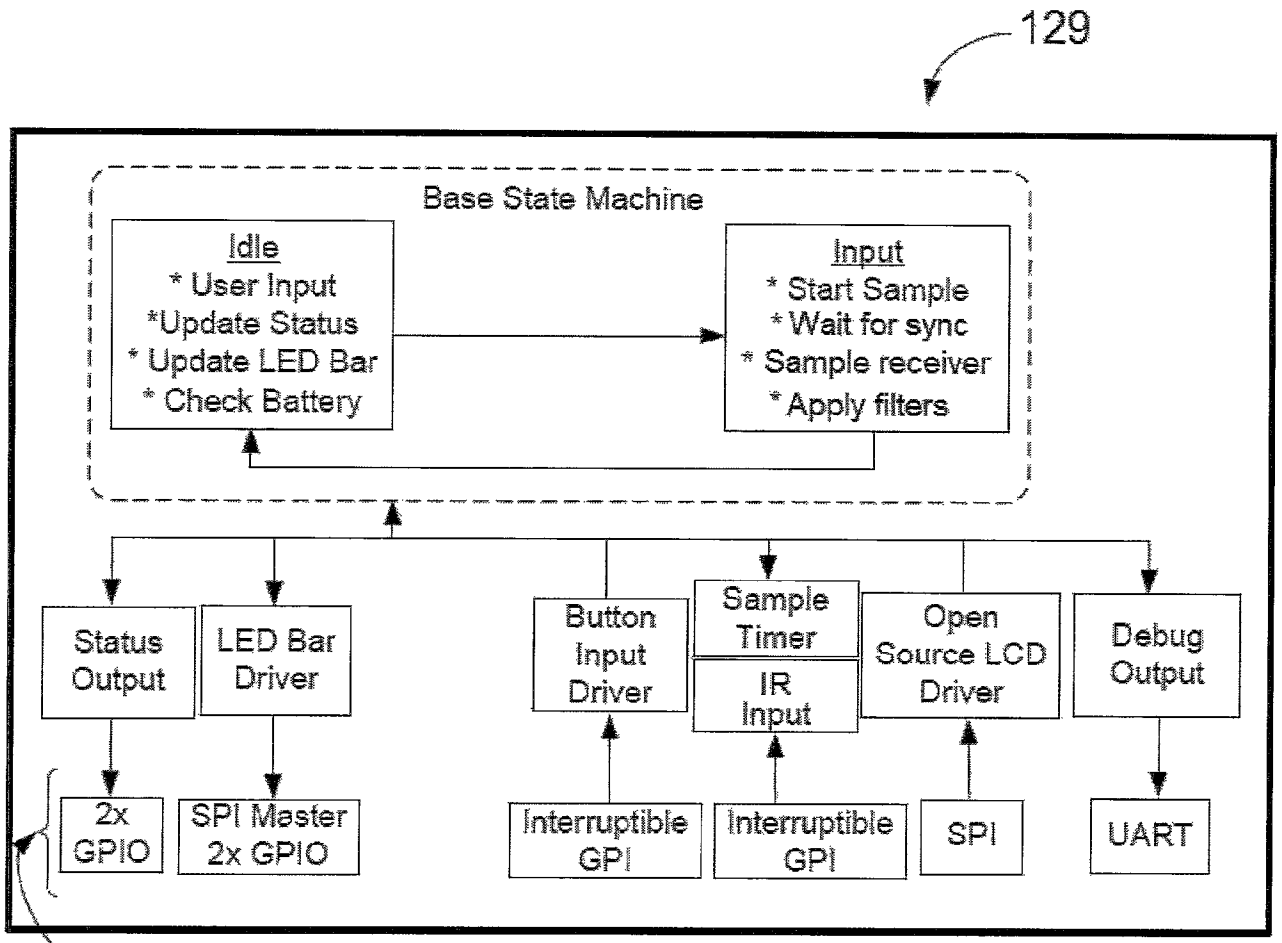
FIGS. 25 and 26 are software block diagrams of the base unit and the belt unit of FIG. 19.
Figure 26:
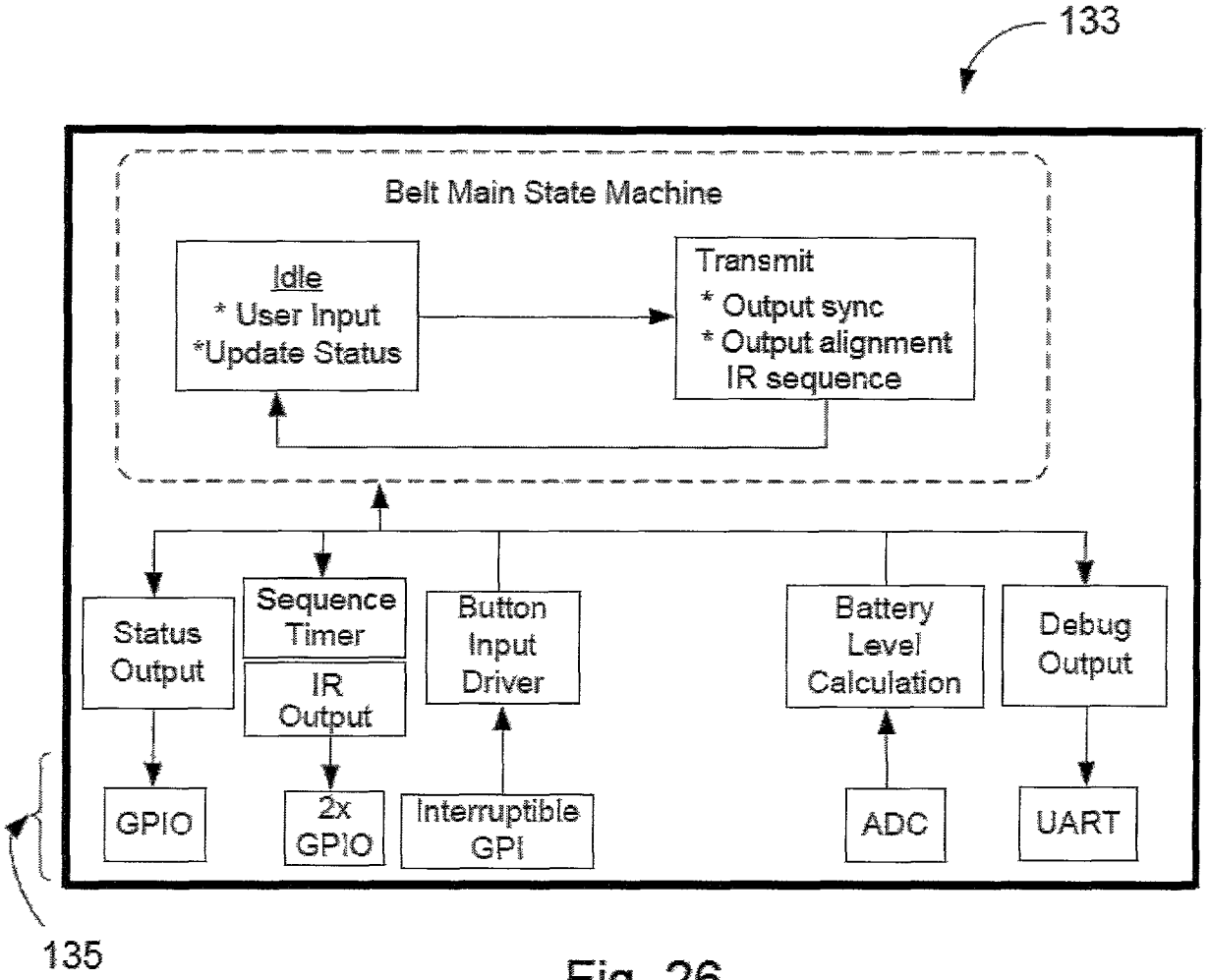

Referring now also to FIGS. 25 and 26 in the drawings, software block diagrams of base unit 91 (FIG. 25) and belt unit 93 (FIG. 26) are illustrated. Software in base unit 91 is responsible for sensing and determining the alignment of user 127 and controlling the indicators. Diagram 129 represents the software block diagram for unit 91. Elements along row 131 pertain to external interfaces. Diagram 133 represents the software block diagram for unit 93. Elements along row 135 pertain to external interfaces.

As noted above for device 10, device 89 may include additional features, including indicating distance to the reference location and notifying the user of environmental weather conditions (e.g., temperature, wind speed, humidity).

Though position emitters 101B and associated vertical guides 111 of belt unit 91 are shown and described as each pointing one degree away from adjacent components, alternative embodiments of device 89 may use another angle. For example, changing to a two-degree offset would accomplish two things: doubling the field of view from fourteen degrees to 28 degrees and increasing the minimum detectable angle to two degrees. This provides the benefit of making the system less sensitive to small angle changes.

Other embodiments of device 89 may include two-way communication between base unit 91 and belt unit 93. This could allow for use of physical indicators provided by belt unit 93 to user 127, such as notifications that are communicated to the user through the sensory function of touch.

Figure 27:
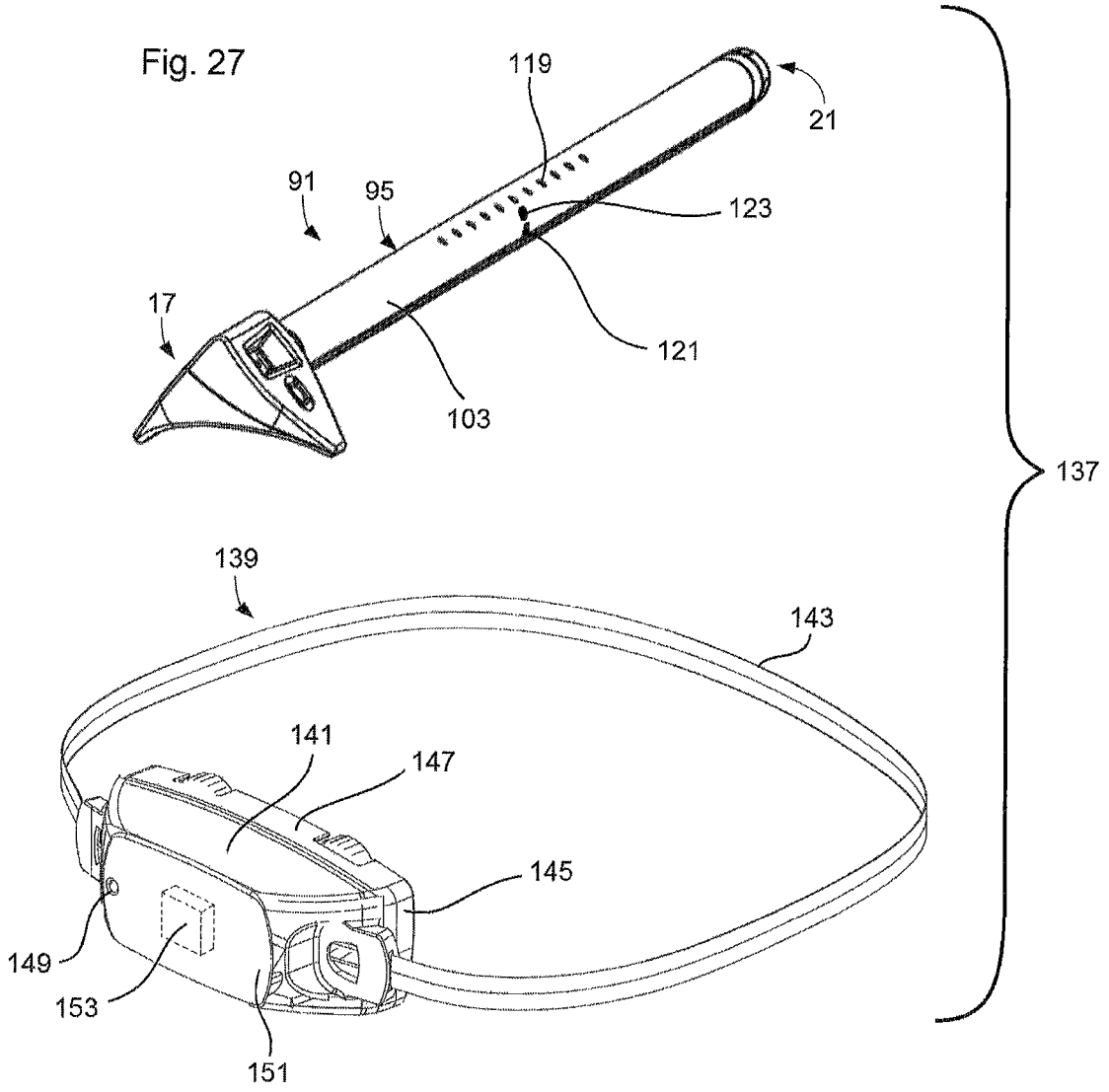
FIG. 27 is a perspective view of a base unit and a belt unit in a training device according to another embodiment of the present application.

Another alternative embodiment of an alignment device is shown in FIG. 27. Training device 137 includes a base unit 91 configured to receive IR signals emitted from a belt unit 139 in order to assist a golfer in properly aligning a stance with a reference location, such as a hole in a golf course. Base unit 91 houses hardware and software used to calculate and/or display the user's alignment with respect to base unit 91 as well as hardware and software used to display such alignment to the user.

As described above, base unit 91 has a similar configuration to base unit 13 and is configured to provide sensory feedback to the user regarding user alignment with base unit 91.

Belt unit 139 is configured similarly to belt unit 93 (described above) and comprises a belt housing 141 and a strap 143. Housing 141 contains a battery unit 145 and electronics 147 (hardware and software). An IR emitter 149 is mounted in a front cover 151 of housing 141. An accelerometer module 153 is located within housing 141 and behind front cover 151.

Electronics 147 regulate the operations of belt unit 139. Belt unit 139 is configured to detect motion of the user and emit IR signals that are detected by IR receiver 123 on base unit 91. IR receiver 123 is connected to the electronics of base unit 91 for transmitting to those electronics the signals generated by receiver 123 in response to IR detections.

During use, a user will "zero" or "reset" the orientation of belt unit 139 by signaling belt unit 139 and/or base unit 91 that belt unit 139 is in a selected initial orientation relative to base unit 91. For example, in one embodiment the user will align base unit 91 relative to a location, such as a hole at a golf course, and then align front cover 151 of housing 141 adjacent tubular housing 103 of base unit 91. The user then signals, by means of a button or other user input device or interface, that belt unit 139 is in the selected orientation, and then belt unit 139 is attached to the user. The electronics of either base unit 91 or belt unit 139 (or both) may then use motion information from accelerometer module 153 to determine the changing position and/or relative orientation of belt unit 139 to base unit 91. If position and orientation calculations are carried out in electronics 147 of belt unit 139, the relative position information can be communicated to base unit 91 through IR signals transmitted from IR emitter 149 to IR receiver 123. If position and orientation information is calculated by electronics on base unit 91, then the output of accelerometer module 153 can be transmitted using IR emitter 149 to IR receiver 123 for use in the calculations. In either case, the results of the calculations are indicated to the user on base unit 91 with LEDs 119 or with display assembly 17.

While device 137 is shown as having an IR system for transmission of data, it should be understood that device 137 may use any appropriate method of transmission. For example, belt unit 139 may transmit using a radio frequency and may use common data-exchange technologies, such as Wi-Fi or Bluetooth®.

The present application provides at least the following significant advantages, including: (1) the ability to correctly align a user's body with a reference location; (2) continuous real time feedback concerning alignment of the user; (3) portability of the training device; and (4) the training device is able to be used without interfering with a user's golf swing The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A training device, comprising:

a base unit configured to provide sensory feedback and adapted to be spaced from a user;

a central indicator carried on the base unit and configured to indicate a centering location spaced from the base unit;

a belt unit configured to be worn by the user and emit signals toward the base unit; and an electronic system housed in the base unit;

wherein the electronic system detects the signals emitted by the belt unit and provides sensory feedback indicating the angular alignment of the belt unit with respect to the base unit.

2. The training device of claim 1, wherein the central indicator is a laser.

3. The training device of claim 1, wherein the sensory feedback is in the form of at least one of a visual notification, an audible notification, and a physical notification to the user.

4. The training device of claim 1, wherein the signals emitted by the belt unit are infrared signals.

5. The training device of claim 1, further comprising a sync emitter and multiple position emitters.

6. The training device of claim 1, comprising multiple position emitters oriented to emit signals at different angles.

7. The training device of claim 1, further comprising:

a display assembly coupled to the base unit and configured to provide the user with at least one of visual messages and audible messages.

8. The training device of claim 1, wherein the base unit is configured to calculate the distance to the reference location.

9. The training device of claim 1, wherein the belt unit comprises an accelerometer.

10. The training device of claim 1, wherein:

the belt unit comprises an accelerometer; and calculations to determine the angular alignment are performed using data from the accelerometer.

11. A method of orienting the stance of a user to a reference location, comprising:

(a) aligning a base unit with respect to a reference location;

(b) centering a user in translation relative to the base unit, the user wearing a belt unit and being spaced from the base unit;

(c) emitting signals from the belt unit;

(d) receiving the signals by the base unit and using the signals to determine the angular alignment of the user relative to the base unit; and (e) indicating the angular alignment of the user with respect to the base unit and the reference location, allowing the user to use the indication to correct the alignment.

12. The method of claim 11, wherein the angular alignment of the user is continuously determined and indicated as the user adjusts position.

13. The method of claim 11, wherein determining the angular alignment of the user includes detecting which of a plurality of signals emitted by the belt unit are received by the base unit.

14. The method of claim 11, wherein a central indicator indicates a proper position in translation of a user relative to the base unit.

15. The method of claim 11, wherein determining the angular alignment of the user is performed by:

emitting a plurality of sequential signals from the belt unit, the plurality of signals originating from position emitters emitting at angles relative to each other;

receiving by the base unit at least some of the plurality of signals; and determining an angle of the belt unit relative to the base unit that corresponds to the signals received.

16. The method of claim 15, wherein the base unit determines the angle of the user with respect to the base unit.

17. The method of claim 11, wherein the base unit indicates the angular alignment of the user by at least one of a visual notification, an audible notification, and a physical notification to the user.

18. The method of claim 11, further comprising:

providing an accelerometer carried by the belt unit; and wherein determining the angular alignment of the user comprises using data from the accelerometer.

19. A training device, comprising:

a base configured to provide sensory feedback and adapted to be spaced from a user;

a central indicator carried on the base unit and configured to indicate a centering location spaced from the base unit;

a unit configured to emit wireless signals toward the base unit and adapted to be worn by the user; and an electronic system housed in the base unit;

wherein the electronic system uses the signals for providing sensory feedback indicating the angular alignment of the unit with respect to the base.

20. The training device of claim 19, wherein the central indicator is a laser.

* * * * *